US005458442A

United States Patent [19]

Ashmore

[11] Patent Number: 5,458,442

[45] Date of Patent: Oct. 17, 1995

[54] FLEXIBLE ROOF BOLT

[75] Inventor: Peter S. Ashmore, Doncaster, Great Britain

[73] Assignee: Bridon PLC, United Kingdom

[21] Appl. No.: 256,050

[22] PCT Filed: Dec. 8, 1992

[86] PCT No.: PCT/GB92/02273

§ 371 Date: Oct. 19, 1994

§ 102(e) Date: Oct. 19, 1994

[87] PCT Pub. No.: WO93/12324

PCT Pub. Date: Jun. 24, 1993

[30] Foreign Application Priority Data

Dec. 19, 1991 [GB] United Kingdom ..... 9126992

[51] Int. Cl.[6] ..... E21D 20/00

[52] U.S. Cl. ..... 105/302.2; 405/259.1; 405/259.5

[58] Field of Search ..... 405/302.2, 259.1–259.6

[56] References Cited

U.S. PATENT DOCUMENTS

| | | | |
|---|---|---|---|
| 3,311,012 | 3/1967 | Williams | 405/259.5 X |
| 3,389,561 | 6/1968 | Taylor | 405/259.5 |
| 4,139,323 | 2/1979 | Brandstetter | 405/259.5 |

FOREIGN PATENT DOCUMENTS

| | | | |
|---|---|---|---|
| 0379388 | 7/1990 | European Pat. Off. . | |
| 1304652 | 5/1959 | France . | |
| 3532070 | 3/1987 | Germany . | |
| 3905128 | 1/1990 | Germany . | |
| 821702 | 4/1987 | U.S.S.R. | 405/259.5 |
| 1251794 | 10/1971 | United Kingdom . | |
| 1373814 | 11/1974 | United Kingdom . | |

*Primary Examiner*—Randolph A. Reese
*Assistant Examiner*—Frederick L. Lagman
*Attorney, Agent, or Firm*—Cesari and McKenna

[57] ABSTRACT

A load-bearing termination (1) engages an end portion of a rope (3) consisting of strands extending helically around a central void. The termination (1) has an external thread (16) for tensioning purposes and an internal bore (11) which accommodates with the central void to enable injection of grouting fluid.

18 Claims, 1 Drawing Sheet

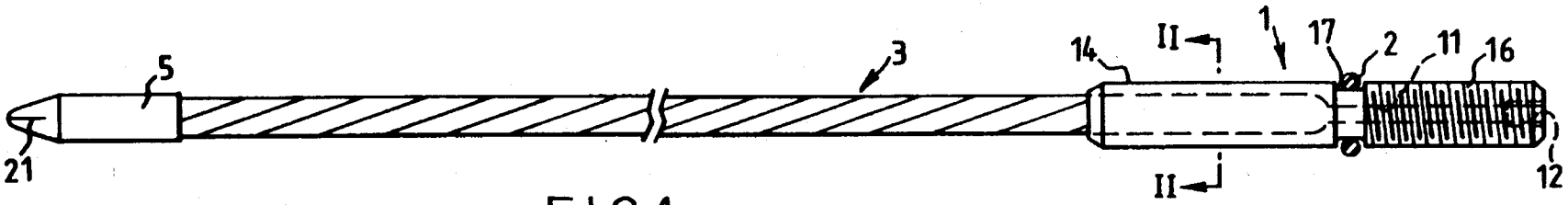
FIG.1
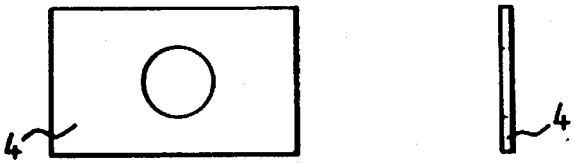
FIG.3
FIG.4
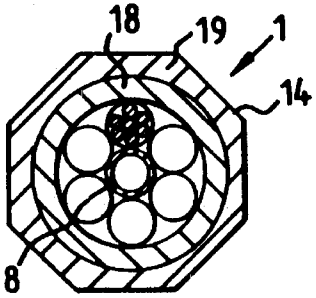
FIG.2
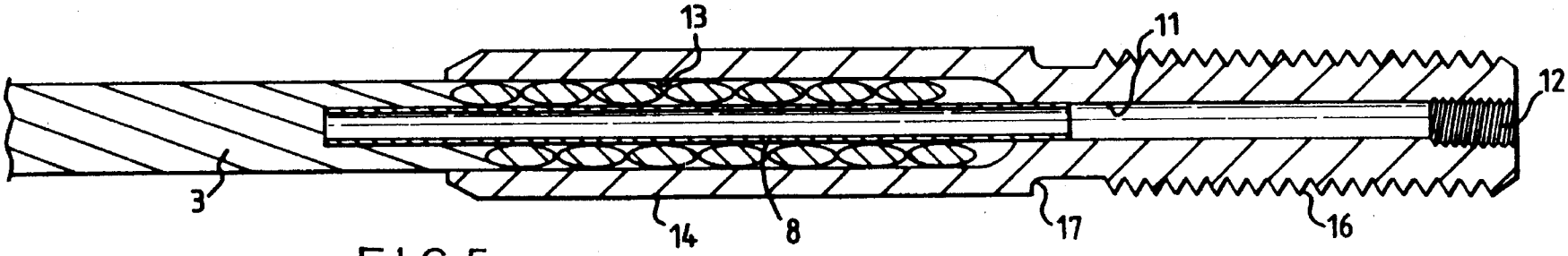
FIG.5

FLEXIBLE ROOF BOLT

This invention relates to the tensile reinforcing members, known as "roof bolts", which are used in underground mining operations for the purpose of stabilisation of the rock strata, for example roof support when tunnelling.

In service the bolts are used in a procedure which comprises:

a) boring holes into the rock strata;

b) introducing bolts which extend axially along the length of the holes; and c) injecting a settable grouting material into each hole so as to substantially fill the voids between the bolt and the hole.

The depth and direction of the holes are designed so that the bolt extends from potentially unstable rock strata into areas of rock which are known to be stable, thus stabilising the rock (e.g. the roof) which was liable to collapse. This objective may be further advanced by attaching a nut and washer to the inboard end of the bolt so that it directly bears upon and supports the inner rock face. After the grouting material has hardened, the nut may be tightened so as to pre-tension the bolt.

The present invention provides a flexible roof bolt comprising a hollow, stranded rope with a load-bearing termination at one end which is provided with an internal bore (for fluid injection purposes) and an external thread (for tensioning purposes). The hollow rope consists of a plurality of strands extending helically around a central void. Each strand comprises a helically spun assembly of wires. The termination engages an end portion of the rope, and its internal bore communicates with the central void of the rope.

The external surface of the termination may also be advantageously provided with one or more flats (for gripping purposes) and an annular sealing means.

The invention will be described further, by way of example only, with reference to the accompanying drawings, in which:

FIG. 1 is a side view of a flexible roof bolt;

FIG. 2 is a section on line II—II in FIG. 1;

FIGS. 3 and 4 are respectively an elevation and a side view of a bearing plate; and FIG. 5 is an enlarged axial section through one end of the roof bolt.

A ductile steel cylindrical fitting 1 has a hollow bore 11 extending the full length of it. The bore 11 at the right hand extremity is threaded internally at 12 to accept a connector for fluid injection purposes, and the bore 11 at the left hand end is enlarged at 13 to accept a wire rope 3 or flexible strength member. After introducing the wire rope 3 into this cavity 13, the left-hand shank 14 of the fitting 1 is deformed radially inwards (e.g. by pressing or swaging) using hardened steel dies to effect a permanent interference with, and gripping of the rope 3. The external profile imparted by the dies may be circular or polygonal in cross-section, but a preferred octagonal profile is illustrated in FIG. 2, which also shows an optional liner 18 of softer metal more ductile than the body 19 of the fitting 1. The right-hand end of the fitting is provided externally with a helical thread 16, which will accept a tensioning nut (not shown) capable of transmitting the full tensile strength of the assembly.

A sealing ring 2 of elastically deformable material is located in a shallow circular groove 17 in the fitting 1, and projects above the thread 16 and die-formed shank 14 of the fitting. In use the ring 2 serves to block the annular space between the fitting 1 and the walls of the hole in the rock face.

The rope 3 is a hollow steel wire rope, preferable of six-strand construction and more preferably 6×7 (6/1) or similar design, typically with a length of 5, 6, 8, or up to 10 m, although longer lengths may be used if required. The hollow rope may be manufactured for example in accordance with the teachings of U.K. Patent specification 1 373 814, wherein the strands may additionally be compacted or may be deformed into one another during manufacture, where it is desired to provide a more dense and rigid member. This would be particularly advantageous where long lengths of flexible bolting are required, since the premature escape of grouting material will be inhibited.

A bearing plate 4 is fitted over the threaded shank 16 of the assembly and under the nut, to spread the load into the rock face.

An optional tubular collar or cap 5, e.g. of heat-shrinkable material, applied to the leading end of the rope 3, assists in guiding the rope into the rock bore hole and prevents the hollow centre of the rope becoming blocked with debris. The end of the cap may be advantageously provided with longitudinal slits 21 (as shown) to allow the grouting fluid to exit under pressure.

A tubular insert 8 of hard rigid material, e.g. steel, is inserted into the hollow bore of the wire rope 3 prior to the attachment of the terminal fitting 1. The tubular insert 8 extends at least for the full length of the pressed shank 14, but not for the full length of the wire rope since this would impair the flexibility of the assembly. The purpose of the insert is to provide a supporting mandrel to the wire rope strands during the terminal pressing or swaging operation, to ensure that the wire crowns are indented into the internal bore of the tubular fitting 1 as it is deformed radially inwards. This ensures that the tensile forces are reliably and efficiently transmitted into the wire rope from the end fitting, whilst preserving the central passage for the flow of the grouting fluid.

The flexible bolting assembly described above offers several major advantages over the prior art, notably in terms of tensile gripping efficiency:

1) By using a stranded wire rope (rather than several helical layers of wires) there is a greater exposure of the wires to the grout material and a better mechanical key due to the penetration of the grout into the irregular interstices of the rope geometry.

2) The serrated outer profile of the stranded rope is suited to the use of both resin based and cementitious grouting systems.

3) Since the hollow wire rope is not provided with a tubular core (or jacket), there is no obstacle to the complete penetration of the grout along the entire length of the bolt, for maximum bonding/gripping effect.

4) The termination/anchorage system is capable of transmitting the full strength of the bolt assembly, owing to the high efficiency of the gripping mechanism, which is more easily achieved with a stranded wire rope.

5) The hard steel tubular mandrel 8 ensures that this termination efficiency is reliably achieved, without obstructing the passage for the flow of grout material.

6) in use, the terminal shank extends part way into the hole in the rock and the smooth circular annular groove 17 and sealing ring 2 prevent the escape of excess grouting material.

7) The pressed portion of the terminal shank may be provided with a plurality of flats to assist in installation of the flexible bolt whereby the end of the bolt may be torsionally gripped and rotated whilst at the same time being pushed into the hole in the rock, in the manner of a screw.

The wire rope construction is again advantageous in this respect, in that it is very capable of transmitting a torque (in one direction) whereas helical layers of wires are prone to "birdcaging" when so treated.

8) Yet a further advantage is that the leading end of the bolt may be cut plain or even tapered for ease of installation, by virtue of the hollow rope robustness and stability (imparted by preforming the strands), without the need for a substantial annular ring or collar as in the case with helical wire cables.

9) Furthermore the gripping efficiency of the wire rope in the grout is so great that there is no need for an anchoring head or sleeve, projecting radially out from the leading end of the rope.

I claim:

1. A flexible roof bolt comprising a hollow, stranded rope (3) consisting of a plurality of strands extending helically around a central void, each strand comprising a helically spun assembly of wires, and a load-bearing termination (1) engaging an end portion of the rope (3), the termination (1) having an internal bore (11) which communicates with the central void of the hollow rope (3) and having an external thread (16).

2. A roof bolt as claimed in claim 1, in which the termination (1) comprises an elongate body having a hollow shank (14) surrounding the said end portion of the rope (3) and an extension beyond the said end portion, the extension having the said external thread (16).

3. A roof bolt as claimed in claim 2, in which the shank (14) has been deformed radially inwards to cause engagement of the termination (1) with the said end portion of the rope (3).

4. A roof bolt as claimed in claim 3, in which the termination (1) includes a ductile liner (18) interposed between the shank (14) and the rope (3).

5. A roof bolt as claimed in claim 2, including a tubular insert (8) within the said end portion of the rope (3), the insert (8) extending at least over the common overlapping length of the said end portion and the shank (14).

6. A roof bolt as claimed in claim 2, in which the external surface of the shank (14) has one or more flats.

7. A roof bolt as claimed in claim 6, in which the external surface of the shank (14) is polygonal in cross-section.

8. A roof bolt as claimed in claim 2, in which the said internal bore (11) of the termination extends axially along the said extension.

9. A roof bolt as claimed in claim 8, in which the outer end portion of the bore (11) has an internal thread (12).

10. A roof bolt as claimed in claim 2, in which the elongate body of the termination (1) has a peripheral groove (17) between the shank (14) and the external thread (16).

11. A roof bolt as claimed in claim 10, including a sealing ring (2) located in the said groove (17).

12. A roof bolt as claimed in claim 1, including a cap (5) applied to the leading end of the rope (3) remote from the said end portion engaged by the termination (1).

13. A roof bolt as claimed in claim 12, in which the cap (5) is made of heat-shrinkable material.

14. A roof bolt as claimed in claim 1, in which the rope (3) includes strands which are exposed to the central void.

15. A roof bolt as claimed in claim 1, in which the rope (3) includes strands which are exposed at the exterior of the rope.

16. A roof bolt as claimed in claim 1, in which the rope (3) has only a single layer of strands.

17. A roof bolt as claimed in claim 16, in which the rope (3) has six strands.

18. A roof bolt as claimed in claim 1, in which the rope (3) comprises seven-wire strands.

* * * * *